United States Patent [19]

Benson

[11] 4,143,972

[45] Mar. 13, 1979

[54] COMBUSTION CONTROL SYSTEM FOR BITUMINOUS DRUM MIXERS

[75] Inventor: Bernard A. Benson, Issaquah, Wash.

[73] Assignee: Boeing Construction Equipment Company, Tukwila, Wash.

[21] Appl. No.: 879,407

[22] Filed: Feb. 21, 1978

[51] Int. Cl.[2] ..... B28C 5/46; B01F 9/00

[52] U.S. Cl. ..... 366/25; 366/233

[58] Field of Search ..... 366/25, 57, 144, 233; 432/105

[56] References Cited

U.S. PATENT DOCUMENTS

| | | | |
|---|---|---|---|
| 1,654,358 | 12/1927 | Ash | 432/105 |
| 2,305,938 | 12/1942 | Turnbull | 366/25 |
| 2,695,461 | 11/1954 | Longley | 432/105 X |
| 4,039,171 | 8/1977 | Shearer | 366/25 |
| 4,075,710 | 2/1978 | Jakob | 366/25 |

*Primary Examiner*—Edward J. McCarthy

*Attorney, Agent, or Firm*—Thomas H. Murray

[57] ABSTRACT

An improvement in drum mixer asphalt plants comprising a combustion chamber which substantially completely surrounds an open flame projecting into the inlet end of the drum mixer and prevents the temperature at any point within the drum from reaching the level where it will burn asphaltic materials to produce pollutants which would otherwise be discharged into the atmosphere. At the same time, the combustion chamber will produce heated gases flowing into the drum at a sufficiently high and uniform temperature to melt the asphalt and permit entry of the asphalt and aggregate, including recycled asphalt paving materials, close to the combustion chamber.

10 Claims, 5 Drawing Figures

COMBUSTION CONTROL SYSTEM FOR BITUMINOUS DRUM MIXERS

BACKGROUND OF THE INVENTION

Drum mixers for asphaltic materials have been developed which include a rotating drum having internal flights for lifting and tumbling aggregate and a bituminous binder to mix the two. A source of high volume heated gas is aligned with the drum for providing the interior of the same with a continuous flow of a hot gaseous medium. In most prior art drum mixers of this type, the heated gases are produced by a burner-blower arrangement at the inlet end of the drum which produces a flame projecting into the drum along its central axis.

As is explained in U.S. Pat. No. 4,039,171, the operation of such drum mixers can result in considerable atmospheric pollution due to the concentrated high temperature gases in and around the open flame. That is, when an open flame projects into the inlet end of the drum mixer, asphaltic materials cannot be introduced near the flame zone of the mixer without causing these materials to vaporize, pyrolize and produce dense smoke. The production of such smoke is associated with the use of those asphalts having relatively low smoking points and is caused by the tumbling of the asphalt through, and consequently subjecting the asphalt to, the extremely high temperatures typically found along the central axis of an operating drum mixer utilizing an open flame at its entrance end. This high temperature zone at the central axis is normally present only near the inlet end of the mixer and eventually dissipates at increasing distances into the mixer from the inlet end. Accordingly, when using low smoking point asphalts, the introduction of the asphalt must oftentimes be made at substantial distances downstream from the inlet end of the mixer. When the asphalt is added at such downstream positions, however, particulate emission is increased for the reason that the aggregate, which contains a certain amount of fines, is tumbled within the drum for a considerable period before it is contacted by the asphalt binder.

The conservation of paving material has been of great interest to the paving industry in recent years. With increased costs of aggregates and asphalts, coupled with lessening supplies of both materials, a need has arisen for new methods and equipment designed to use less of such materials in virgin form. One solution to the material cost and supply problem is the use of old materials removed from existing roadways as an ingredient in a paving mixture being prepared for repaving of existing roadway surfaces. The old, removed materials are crushed and are then introduced into the mixer, usually along with a certain amount of virgin aggregate and asphalt. As the recycled material moves through the drum, the old asphalt binder melts to produce a new mix which can then be used to repave the roadway from which it was taken.

When recycled paving materials are introduced into a drum mixer having an open flame projecting into its inlet end, the production of excessive amounts of pollutants ordinarily occurs due to the fact that the recycled material contains fine particles of asphalt or asphalt-coated aggregate which are subjected to the intense heat of the flame at the entrance end of the drum. As will be understood, this problem cannot be alleviated, as in the case of virgin aggregate, by simply introducing fresh asphalt downstream of the flame since asphalt is inherently present in the recycled material.

In the aforesaid U.S. Pat. No. 4,039,171, a dispersing means is provided within the mixing drum downstream from the burner and extends across the interior cross section of the drum to disperse the heating gases uniformly across the interior of the drum and prevent burning of asphaltic materials and resultant pollution. Preferably, the dispersing means is in the form of a screen extending across the drum. While a dispersing means of this type materially improves the elimination of pollutants and permits the introduction of recycled aggregates and bituminous materials nearer to the burner, it is not altogether satisfactory. In particular, difficulty has been encountered in selecting a material for the screen which is capable of withstanding the extremely high temperatures involved, on the order of 2000° F. and above.

SUMMARY OF THE INVENTION

In accordance with the present invention, a combustion chamber is provided for drum mixer asphalt plants which substantially completely surrounds the open flame projecting into the inlet end of the drum mixer and prevents the temperature at any point within the drum from reaching the level where it will burn asphaltic materials to produce pollutants. By employing the combustion chamber of the invention, direct radiation is greatly reduced because the line-of-sight path between the flame and the aggregate to be heated is interrupted. That is, the combustion chamber acts as a radiation shield between the highly luminous flame and the downstream material. Secondly, the thermal energy entering the drum is more uniformly distributed over the drum cross section. This energy distribution is accomplished by the pressure drop and associated mixing effect of the combustion chamber. Finally, the combustion chamber of the invention acts to mix excess combustion air with the primary combustion products to yield a lower temperature level in the gas stream entering the drum. This lower temperature level is especially important in the reprocessing of pavements to be recycled. That is, the lower temperatures produced with excess air mixing prevent the "flashing" or burning of fine particles of asphalt or asphalt-coated aggregate which become airborne in the drum mixer.

In the preferred embodiment of the invention, the combustion chamber comprises a cylindrical housing surrounding a flame from a burner and has an apertured covering at the end of the chamber opposite the burner, this apertured covering preferably being in the form of a truncated cone. A suitable number of openings are also provided in the wall of the cylindrical housing, the openings being formed by tabs punched from the wall of the housing to facilitate the entrance of air which supports combustion and which acts to cool the wall of the chamber to a temperature below that of the flame. Up to 70% of the primary air and all of the excess air enter the combustion chamber through the slots in the wall of the aforesaid cylindrical housing. This air is forced to diffuse and mix with the ongoing combustion to provide a complete chemical reaction. The combustion chamber walls thus operate at an equilibrium temperature well below the flame temperature. This is due to passive cooling from the surface of the chamber in the form of radiation and natural convection and to the cooling effects of the secondary air forced through the mixing slots. In this respect, air entering through the slots runs, for some distance, in a boundary layer along the cylindrical surface which directly cools that surface. When applied to drum mixing asphalt plants, the combustion control system of the invention permits smoke-free recycling of crushed asphalt pavement and at the same time permits the early injection of liquid asphalt as a dust emission control medium.

The above and other objects and features of the invention will become apparent from the following detailed description taken in connection with the accompanying drawings which form a part of this specification, and in which.

Figure 4:
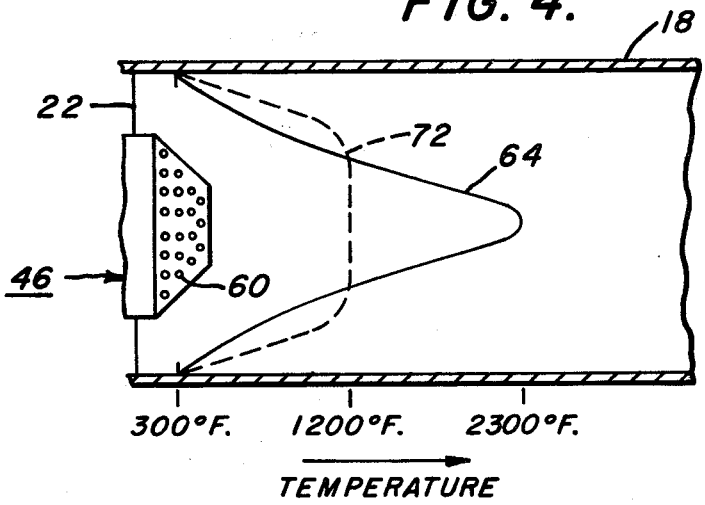
Figure 5:
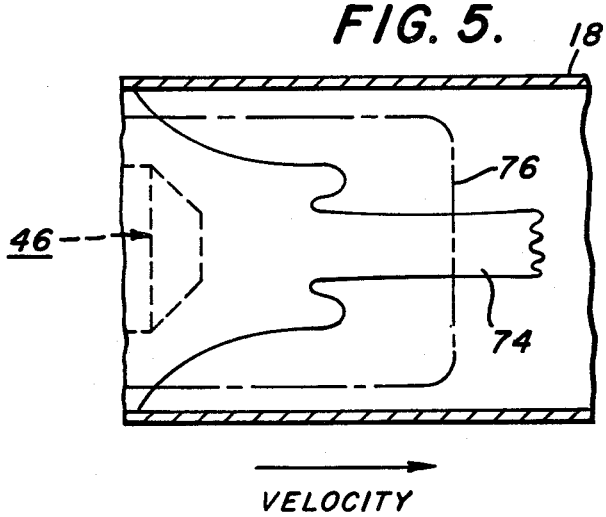

FIG. 4 comprises a temperature profile showing the effect of the combustion chamber of the invention as contrasted with an open flame; and FIG. 5 is a plot of the velocity of the heating gases within the drum for the case where an open flame is employed and the case where the combustion chamber of the invention is used.

Figure 1:
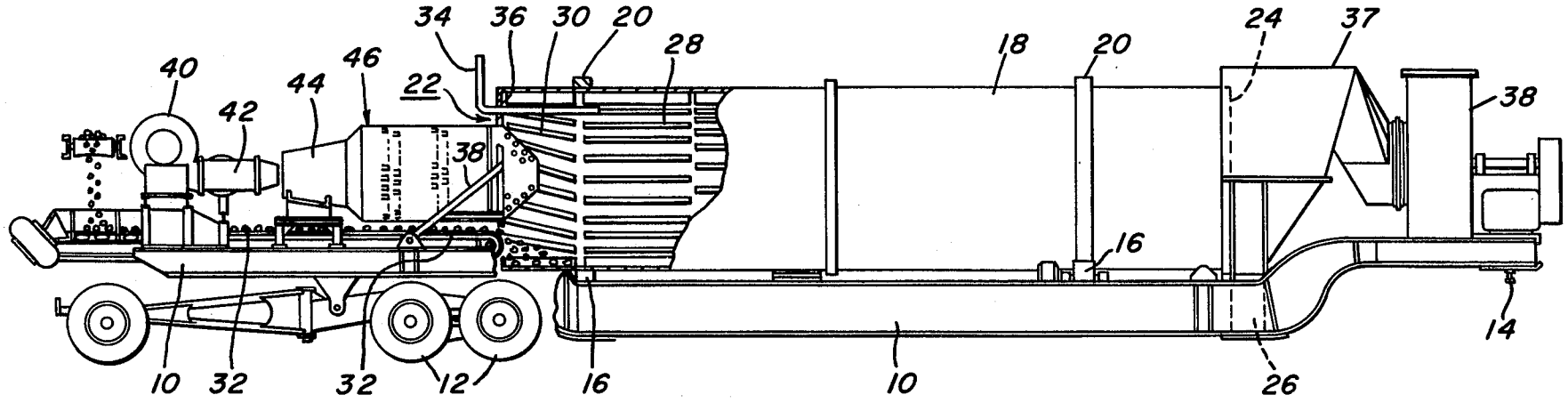
FIG. 1 is an elevational view, partly cut away, of one embodiment of an asphalt mixer with which the present invention may be used.

With reference now to the drawings, and particularly to FIG. 1, the drum mixer shown comprises a lower frame 10 mounted on wheels 12. The end of the frame 10 opposite the wheels 12 is provided with a connection 14 adapted to be inserted into the fifth wheel of a tractor such that the entire drum mixer assembly can be moved from place-to-place. Whether the mixer is portable or stationary, however, is unimportant as regards the present invention.

The frame 10 carries sets of rollers 16, at least one set of which is driven. The mixer itself comprises a cylindrical drum 18 having metal tires 20 which ride on the rollers 16 such that as the rollers 16 are caused to rotate by a suitable drive mechanism, not shown, so also will the drum 18. The drum has an inlet end 22 and a discharge end 24 where the bituminous binder-aggregate mix drops into an exit chute 26 where it may be collected. The drum 18 is provided along its inner wall with a plurality of lifting flights 28 which serve to lift and tumble the materials being mixed in the drum across the inner section of the drum. The drum is also provided with a plurality of spirally-disposed fast flights 30 at its entrance end. The flights 30 do not tumble the material across the drum but instead serve to auger materials to be mixed rapidly into the mixing zone of the drum.

When the mixer is operated to produce a bituminous paving composition, aggregate is introduced into the drum 18 near its inlet end 22 by means such as a conveyor belt 32. Additionally, a bituminous binder, such as preheated asphalt cement, is discharged onto the aggregate within the drum from asphalt feed pipe 34 projecting into the inlet end 22. A generally annular firewall 36 is disposed within the inlet end 22 and is reinforced by support brackets 38 mounted on the frame 10. The firewall 36, of course, has openings therein to permit aggregate on the conveyor 32 to be discharged into the drum 18 and to permit the asphalt supply pipe 34 to project through the firewall. At the discharge end 24 of the drum 18 is an exhaust shroud 37 which conducts hot gases to a blower fan 38 which exhausts them into the atmosphere.

Projecting through the annular opening in the firewall 36 is the novel combustion chamber means of the invention for introducing a heated stream of gases into the inlet end of the drum 18. It comprises a forced-air blower 40, a burner 42, an ignition port assembly 44 and the combustion chamber 46 itself.

Figure 2:
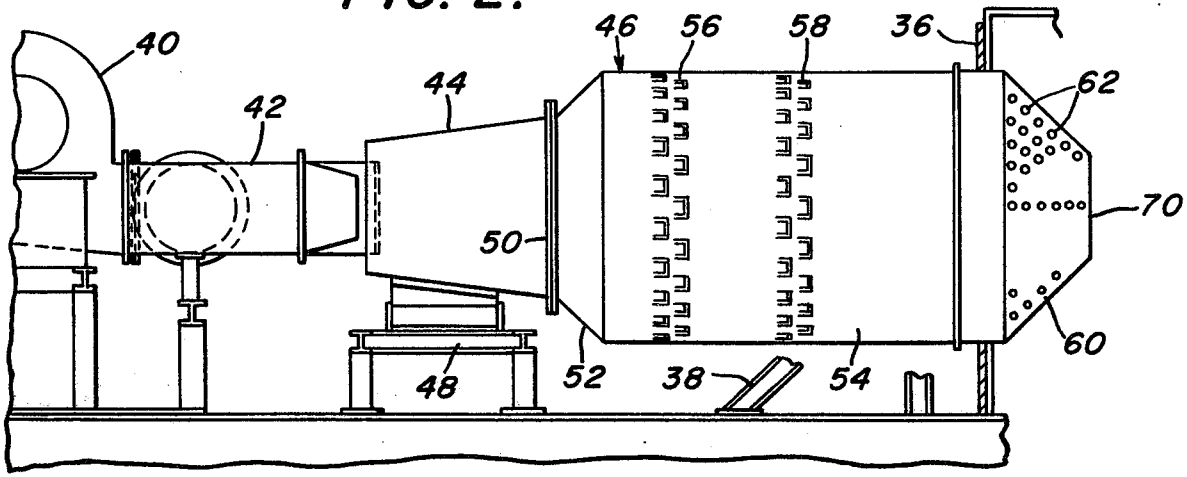
FIG. 2 is an enlarged view of the combustion chamber of the invention.

The details of the combustion chamber 46 and its associated components are shown in FIG. 2. The ignition port assembly 44 is carried on a support 48 and is connected through flanges 50 to the combustion chamber 46 which has at its forward end an outwardly-flared connecting ring 52. The combustion chamber itself comprises a cylindrical housing 54 which completely surrounds the flame from the burner 42 and is provided on its periphery with two rows of slots 56 and 58. The slots 56 and 58 are formed by punching into the wall of the chamber 54 tabs which are joined to the wall at their trailing edges and which project downwardly into the chamber at their forward ends to provide openings for the entrance of air into the combustion chamber. At the end of the chamber 54 opposite the ignition port assembly 44 is a truncated cone 60 having a plurality of openings 62 therein. Only this truncated cone 60 projects beyond the firewall 36.

As was explained above, in a prior art rotary drum mixer, the fuel burner 42 is fired directly into the drum with the flame volume penetrating ½ to 2 drum diameters into the drum. This yields an extreme heat transfer rate between the combustion gases and the process material due to the concentrated high temperature gases in and around the flame. The primary heat transfer mechanism is direct radiation augmented by high rates of convection heating. Under these conditions, asphaltic materials cannot be introduced near the flame zone of the drier without causing these materials to vaporize or pyrolize and produce dense smoke.

The theoretical temperature profile of an open flame projecting into the drum 18 is shown in FIG. 4, this temperature profile being indicated by the solid-line curve 64. It will be noted that the temperature increases from about 300° F. immediately adjacent the inlet end 22 to as high as 2500° F. along the axis of the drum. When asphaltic materials, and particularly fines from recycled asphalt, contact or come near the extremely high temperature zone of the open flame along the axis of the drum, they burn and produce dense smoke.

Figure 3:
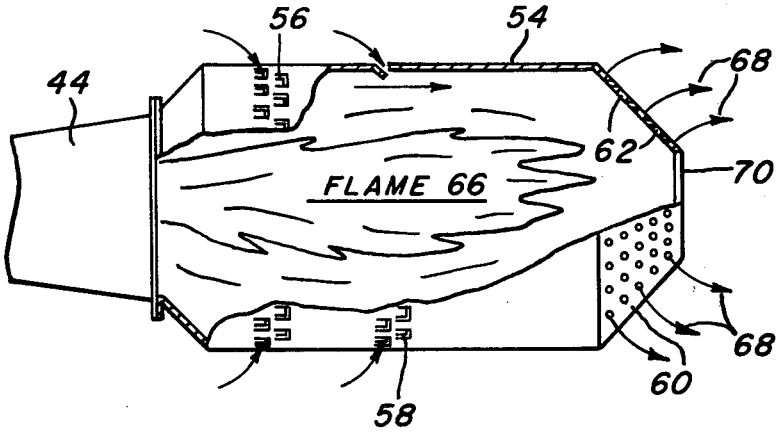
FIG. 3 is a partially broken-away cross-sectional view of the combustion chamber showing the manner in which secondary air enters slots in the sides of the chamber and heated air flows through a truncated cone at the end of the combustion chamber.

FIG. 3 is a cut-away view of the combustion chamber of the invention showing the burner flame 66 within the combustion chamber. It will be noted that the combustion chamber 54 is sized in diameter and length to completely contain the flame volume generated by the fuel burner 42. Fuel and a portion of the primary combustion air enter the combustion chamber through the ignition port assembly 44. However, up to 70% of the primary air and all of the secondary, excess air enter the combustion chamber through the slots 56 and 58. This air passing through the slots 56 and 58 is forced to diffuse and mix with the ongoing combustion to provide a complete chemical reaction (i.e., complete combustion). The air entering the slots 56 and 58 represents from 25% to 300% excess and is caused to flow due to a reduced pressure in the combustion chamber.

Once in the combustion chamber, the excess air is fully mixed with the combustion products by the action of turbulence in the chamber and by the truncated cone 60 at the end of the combustion chamber. By varying the quantity of excess air, the output temperature from the combustion chamber is controllable. Furthermore, since the combustion process is carried out in an adiabatic environment (adiabatic relative to energy released), with excess air present, there is no unburned fuel in the discharged gases which are schematically indicated by the arrows 68 in FIG. 3.

The wall of the cylindrical combustion chamber 54 operates at an equilibrium temperature well below the flame temperature. This is due to passive cooling from the surface of the chamber in the form of radiation and natural convection bur primarily because of the cooling effects of the secondary air forced through the mixing slots 56 and 58. Air entering through the slots runs, for some distance, in a boundary layer along the interior cylindrical surface of the combustion chamber 54; and this boundary layer directly cools the surface. The truncated mixing cone 60 operates at a temperature below the exit gas temperature due to re-radiation from its downstream facing surface.

The mixing cone 60, in its preferred embodiment, is a truncated cone of substantially 45° half angle with a base diameter 2 to 3 times the diameter of its flat-nose portion 70 which also has openings therein. The holes 62 in the truncated cone 60, as well as those in the nose portion 70, are perpendicular to the interior surface of the cone and uniformly spaced to yield a total hole area of from 20–40% of the cone surface area. As will be understood, the mixing cone causes a pressure drop and mixing effect that yields a uniform temperature and velocity level in the emerging hot gases over the whole surface area of the mixing cone. This is shown in FIGS. 4 and 5. In FIG. 4, the broken-line curve 72 indicates the theoretical temperature profile of the hot gases obtained with the use of the combustion chamber of the invention. Note that the maximum temperature under these conditions is approximately 1200° F. more or less uniformly distributed over the cross-sectional area of the drum 18. Note also that the maximum temperature of the gases flowing from the combustion chamber 46 is about 1200° F. which will melt asphaltic materials, including those introduced as part of a recycled aggregate, but at the same time will not cause asphaltic particles or a stream of injected asphalt to burn and produce dense smoke.

The theoretical velocity profile with and without the combustion chamber of the invention is shown in FIG. 5 where the curve 74 represents the velocity profile produced with an open flame and the broken line 76 indicates that produced with the combustion chamber of the invention. It will be noted that the velocity profile is much more uniform over the cross-sectional area of the drum than is the case with an open flame.

The combustion chamber of the invention permits smoke-free processing of crushed asphalt pavement to be recycled and the early injection of liquid asphalt as a dust emission control medium. That is, the asphalt can be injected closer to the inlet end 22 without burning and, hence, will more quickly coat fine particulate materials present in the aggregate.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In a mixer for bituminous paving compositions of the type having a rotatable drum with a discharge end and an inlet end for the reception of aggregate and a bituminous binder, and means located at said inlet end for directing heated gases into the interior of said drum to melt the bituminous binder; the improvement in said heating means which comprises:

(a) burner means for producing an open flame substantially aligned with the central axis of said drum;

(b) blower means for directing the open flame toward the interior of said drum; and (c) a combustion chamber substantially completely surrounding said open flame, the combustion chamber having openings therein to permit heated gases of essentially uniform temperature to flow into the interior of said drum while preventing burning of asphaltic materials introduced into the drum by radiation and convection from said flame.

2. The improvement of claim 1 wherein said combustion chamber comprises a cylindrical housing surrounding said flame and having an apertured covering at the end of the chamber opposite said burner.

3. The improvement of claim 2 including openings in the side of said cylindrical housing.

4. The improvement of claim 3 wherein said openings are formed by tabs punched from the wall of the cylindrical housing, the tabs being joined to the housing wall at their ends opposite said apertured opening to facilitate the entrance of air which supports combustion and acts to cool the wall of the housing to a temperature below that of said flame.

5. The improvement of claim 3 wherein said apertured covering comprises a truncated cone having openings therein and an essentially flat cover plate on the small diameter end of said truncated cone, said flat cover plate also having openings therein.

6. The improvement of claim 5 wherein said truncated cone is of substantially 45° half angle with a base diameter of 2 to 3 times the diameter of said flat cover plate.

7. The improvement of claim 6 wherein the apertures in said truncated cone and said cover plate comprise 20% to 40% of the total area of said apertured covering.

8. The improvement of claim 5 including a firewall at the inlet end of said drum, and wherein only said truncated cone projects through said firewall and into the interior of said drum.

9. The improvement of claim 3 wherein the openings in the side of said cylindrical chamber are shaped and proportioned to produce a boundary layer of air along the cylindrical inner surface of said cylindrical chamber to cool the same.

10. The improvement of claim 3 wherein the openings in the side of said cylindrical chamber are proportioned such that 25% to 300% excess air necessary to support combustion flow through said openings.

* * * * *